US006488545B1

(12) United States Patent
Meyer

(10) Patent No.: US 6,488,545 B1
(45) Date of Patent: Dec. 3, 2002

(54) ELECTRICAL SIGNAL INTERCONNECT ASSEMBLY

(75) Inventor: Daniel B. Meyer, Lake Oswego, OR (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 09/953,056

(22) Filed: Sep. 14, 2001

(51) Int. Cl.[7] ..... H01R 13/64
(52) U.S. Cl. ..... 439/680; 439/248; 439/638
(58) Field of Search ..... 439/680, 638, 439/675, 581, 546, 248, 347, 559

(56) References Cited

U.S. PATENT DOCUMENTS 3,253,249 A * 5/1966 Hess et al. ..... 439/546
3,378,812 A * 4/1968 Fitzgerald ..... 439/546
3,399,374 A * 8/1968 Pauza et al. ..... 439/355
4,245,875 A * 1/1981 Shaffer et al. ..... 439/680
4,426,127 A * 1/1984 Kubota ..... 439/578
4,697,859 A * 10/1987 Fisher, Jr. ..... 439/246
5,558,541 A * 9/1996 Botka et al. ..... 439/675
5,888,101 A * 3/1999 Dent et al. ..... 439/680
6,174,206 B1 * 1/2001 Yentile et al. ..... 439/638
6,379,183 B1 * 4/2002 Ayres et al. ..... 439/578
6,383,031 B1 * 5/2002 Law et al. ..... 439/680
6,402,549 B1 * 6/2002 Ayres et al. ..... 439/578
6,402,565 B1 * 6/2002 Pooley et al. ..... 439/680

* cited by examiner

*Primary Examiner*—Brian Sircus
*Assistant Examiner*—Hae Moon Hyeon
(74) *Attorney, Agent, or Firm*—William K. Bucher

(57) ABSTRACT

An electrical signal interconnect assembly has first and second high speed coaxial interconnects with each interconnect having a male and female side. One of the male and female side of the first interconnect is floatably mounted on the assembly with the other side mounted on an electrical instrument. The second coaxial interconnect is mounted on a mechanical alignment facility having coarse and fine mechanical alignment portions with the coarse mechanical alignment portion including a closely mating pocket and body. One of the male and female side of the interconnect is mounted on the pocket with the other side mounted on the body. One of the pocket and body is mounted on the interconnect assembly and the other of the pocket and body is mounted on the electrical instrument. A coaxial cable electrically connects the two coaxial interconnects together in the interconnect assembly.

28 Claims, 9 Drawing Sheets

ELECTRICAL SIGNAL INTERCONNECT ASSEMBLY

BACKGROUND OF THE INVENTION

The present invention relates generally to electrical signal interconnect assemblies and more particularly to a signal interconnect assembly for routing an electrical signal from a signal output to a signal input of a test and measurement instrument, such as oscilloscope, waveform generator, spectrum analyzers, network analyzers and the like.

Test and measurement instruments, such as oscilloscopes, have one or more input signal connectors for coupling one or more measurement probes to the instrument. Typical input signal connectors include BNC and SMA connectors. These types of connectors couple electrical signals from the measurement probe that acquires the signals from a device under test to circuitry within the instrument.

Measurement testing of optical component and assemblies has become an important requirement for oscilloscopes with the increased use of these devices in the electronics industry. The oscilloscope is provided with an optical-to-electrical (O/E) converter that receives an optical signal from the optical device under test via an optical cable. The O/E converter converts the optical signal to an electrical signal and couples the electrical signal via one of the electrical signal input connectors to the oscilloscope. An important requirement for such an oscilloscope and O/E converter system is the calibration of the oscilloscope-O/E converter combination. That is the O/E converter and the oscilloscope are calibrated as a combined unit to produce an optical reference receiver measurement system having a frequency response that matches a $4^{th}$ order Bessel-Thompson frequency response. Such an optical reference receiver measurement system is well suited for measuring the characteristics of telecommunication system optical components and assemblies.

A limitation on the above described oscilloscope optical reference receiver system is that the calibration of the system is maintained only with the O/E converter calibrated with the oscilloscope. If the different O/E converter is used with the oscilloscope or the O/E converter is used with a different oscilloscope, the optical signal measurement system provides a normal or average response and not a reference receiver response. Customers who switch O/E converters between oscilloscopes loss the $4^{th}$ order Bessel-Thompson frequency response of calibrated reference receiver.

One solution to this problem is to build the O/E converter into the oscilloscope and couple the output of the O/E converter directly to input circuitry of one of the channels in the oscilloscope. One drawback to this solution is the loss of one oscilloscope channel that could be used for making other types of measurements. A second solution would be to add a precision, high frequency relay switch prior to the input circuitry of the selected oscilloscope input channel. This allows the channel to be used as a standard signal input as well as providing the input from the O/E converter. A drawback to this solution is that the relay switch would introduce additional loss into the channel and possibly generate anomalies, such as reflections, into the measured signal.

What is needed is an interconnect solution for coupling the output of an internal O/E converter in a measurement instrument, such as an oscilloscope, that does not reduce the number of available input channels to instrument nor increase signal loss in the channel.

SUMMARY OF THE INVENTION

Accordingly, the present invention is to an electrical signal interconnect assembly useable as a signal routing adapter with a measurement instrument, such as an oscilloscope, for coupling an output signal from an O/E converter internally disposed within the instrument to an input signal connector on the instrument. The electrical signal interconnect assembly has first and second high speed coaxial interconnects with each coaxial interconnect having a central signal conductor and a surrounding shield conductor. Each of the coaxial interconnects have a male side including a male shield contact mateable with a female side having a shield sleeve defining a chamber including a contact facility having a compliant portion operable to flexibly grip the male shield contact. One of the male and female mating sides of the first coaxial interconnect is selected and floatingly attached to one side of a panel over a first aperture formed in the panel. The panel has a second aperture over which a mechanical alignment facility is attached on the same side of the panel as the first coaxial interconnect. The mechanical alignment facility has coarse and fine mechanical alignment portions with the coarse mechanical alignment portion including a closely mating pocket and body. The pocket has a rim and a floor recessed below the rim such that the rim provides a first angular displacement limit of the body. The fine mechanical alignment portion includes a notch defined in one of the pocket and body and a key closely mating with the notch defined in the other of the pocket and body such that the notch provides a second angular displacement limit of the body. One of the male and female mating sides of the second coaxial interconnect is selected and attached to one of the pocket and body. A coaxial cable having a cental signal conductor and a surrounding shield conductor is attached to the corresponding cental signal conductors and a surrounding shield conductors of the first and second coaxial interconnects on the opposing side of the panel.

The first and second interconnects are preferably blind mating interconnects with the associated mating sides of the first and second coaxial interconnects and one of the pocket and body mounted on an electrical instrument and coupled to circuitry in the instrument. In the preferred embodiment, the female mating sides of the interconnects are connected to the instrument. The electrical signal interconnect assembly further includes a separate electronic data interconnect having a first side connected to the pocket and a second side connected to the body. At least one side of the data interconnect includes compliant contacts operable to contact a corresponding set of contacts on the other side, over a range of depths with which the body is inserted into the pocket. In the preferred embodiment, one side of the data interconnect includes pogo pins contained within the pocket, and the other side includes a fixed contact surface.

A housing is attached to the opposing side of the panel with the housing having a base with depending sidewalls positioned against the opposing side of the panel. The base may include cantilever spring members disposed on the base with each cantilever spring member having a fixed end attached to the base a flexible free end with the free ends defining an aperture. In one embodiment, the cantilever spring members extend above the base in a direction opposite the sidewalls. In a second and preferred embodiment, the base includes an aperture with the cantilever spring members disposed adjacent to the aperture and extending below the base in the same direction as the sidewalls. Preferably, the cantilever spring members are integrally formed with the housing.

The objects, advantages and novel features of the present invention are apparent from the following detailed description when read in conjunction with appended claims and attached drawings.

BRIEF DESCRIPTION OF THE DRAWING FIGURES

DETAILED DESCRIPTION OF THE PREFERRED EMBODIMENT

Figure 1:
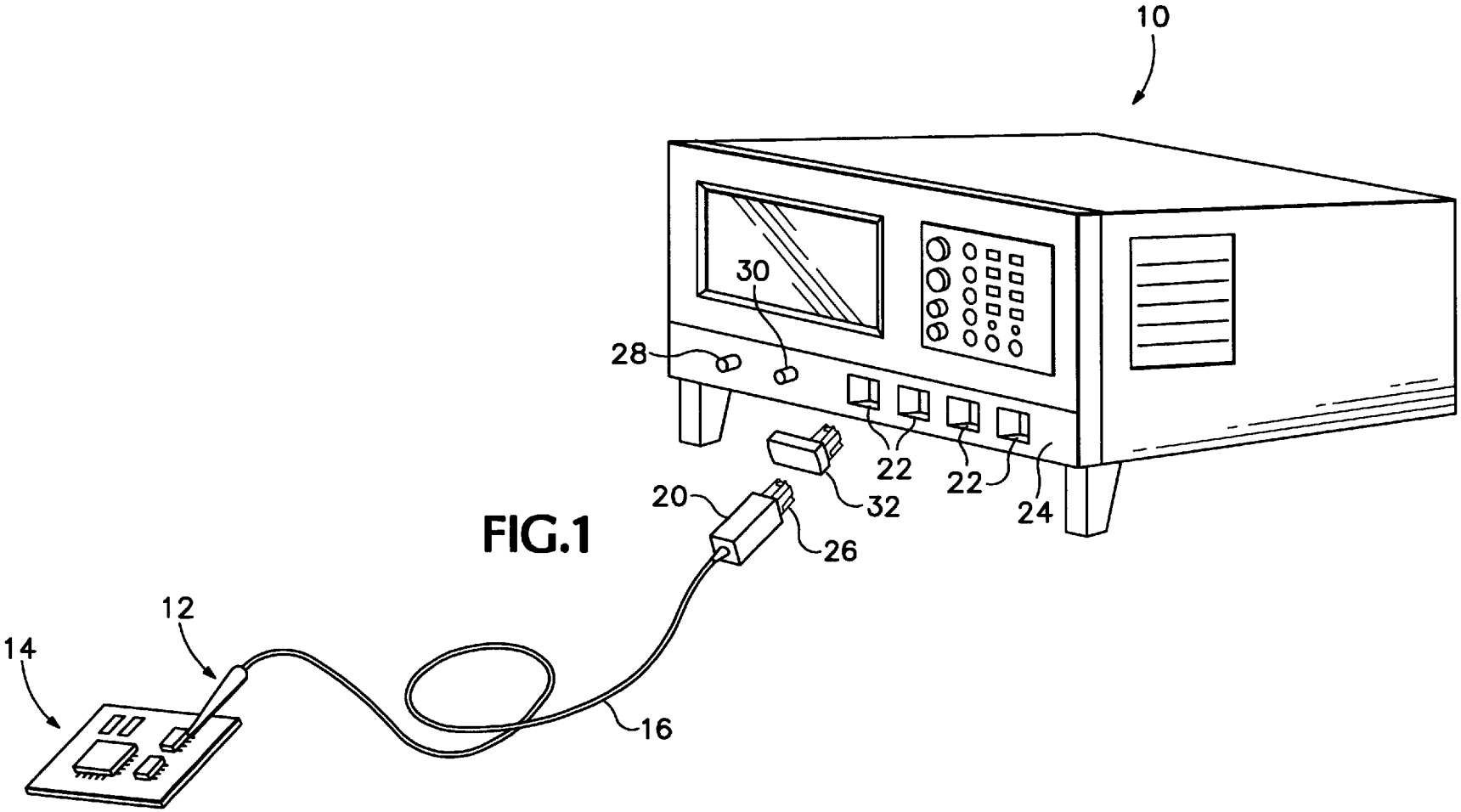
FIG. 1 is a perspective view of an instrument and the electrical signal interconnect assembly according to the present invention.

FIG. 1 shows an electronic instrument such as a digital oscilloscope 10 having a measurement probe 12 for testing a circuit or device under test 14. The probe includes a cable 16 extending to a probe interconnect housing 20. The probe interconnect housing 20 is terminated with an interconnect body 26 that is part of a mechanical alignment facility having structural alignment features for a secure and aligned mechanical connection to the instrument. The details of the mechanical alignment facility will be discussed in greater detail below. The interconnect body 26 includes a high speed coaxial interconnect and electrical connectors for an effective high speed signal and data transmission. The cable 16 preferably includes a single coaxial wire having a central signal conductor and a surrounding ground or shield conductor. The, cable 16 further includes a multi-line bus for transmitting control signals and power between the probe and the instrument 10. The housing 20 is removably connected to one of several interconnect receptacles 22 on the front panel 24 of the instrument, that contains a high speed coaxial interconnect. The receptacle may also contain circuitry needed to provide a connection from the cable to the instrument. The receptacle 22 is a pocket or box-shaped body having an open side facing away from the instrument front panel 24, and an open side facing the front panel, essentially providing a tube of rectangular cross section. The front panel further includes an optical connector 28 that receives optical signals from an optical device under test via an optical cable. The optical connector 28 is optically coupled to an optical-to-electrical (O/E) converter within the instrument 10. The O/E converter converts the optical signal to an electrical signal which is coupled to the front panel 24 of the instrument via a high speed coaxial interconnect 30. An electrical signal interconnect assembly 32 couples the electrical signal from the front panel coaxial interconnect 30 to the coaxial interconnect of one of the receptacles 22.

Figure 2:
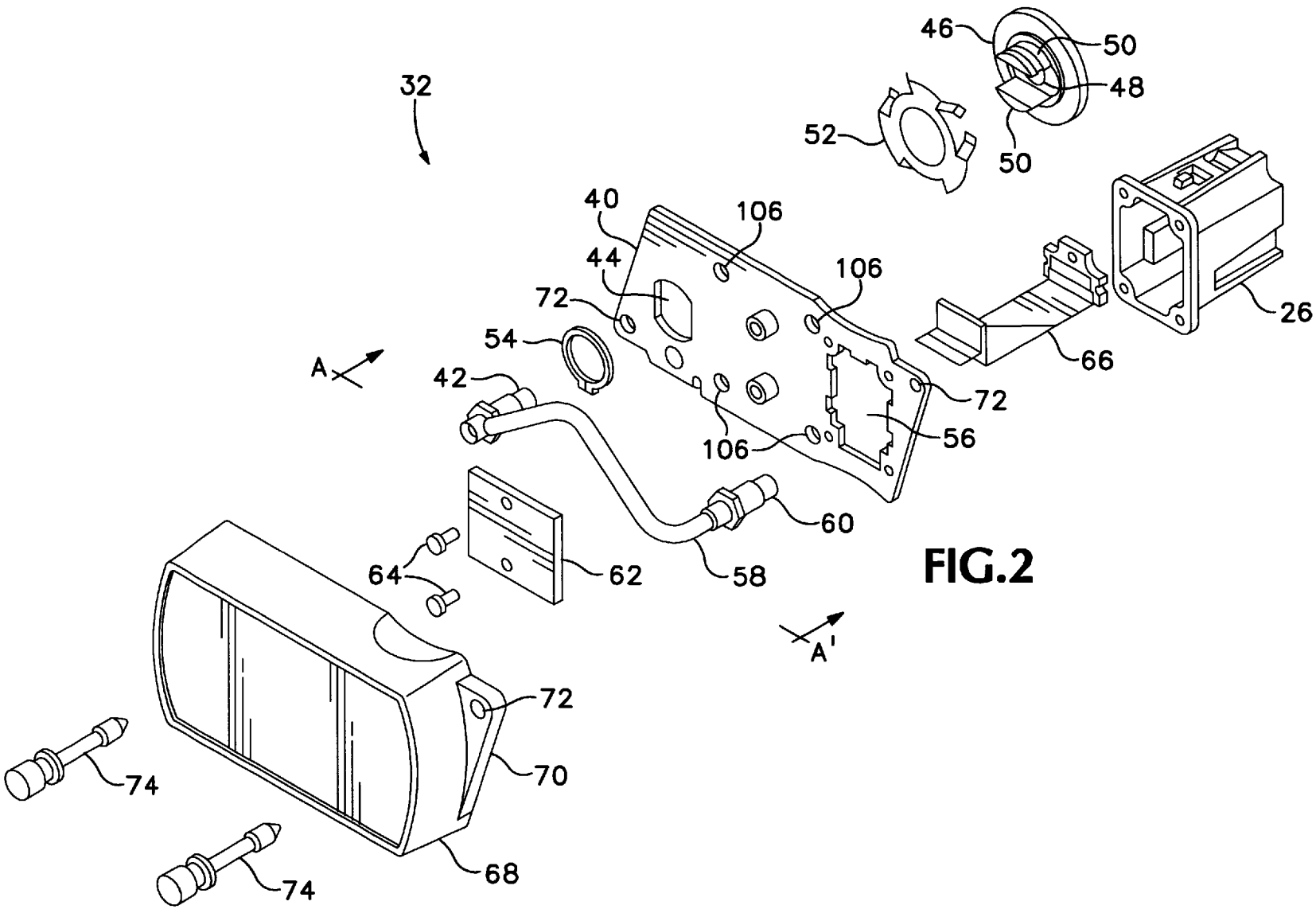
FIG. 2 is an exploded perspective view of the electrical signal interconnect assembly according to the present invention.
Figure 3:
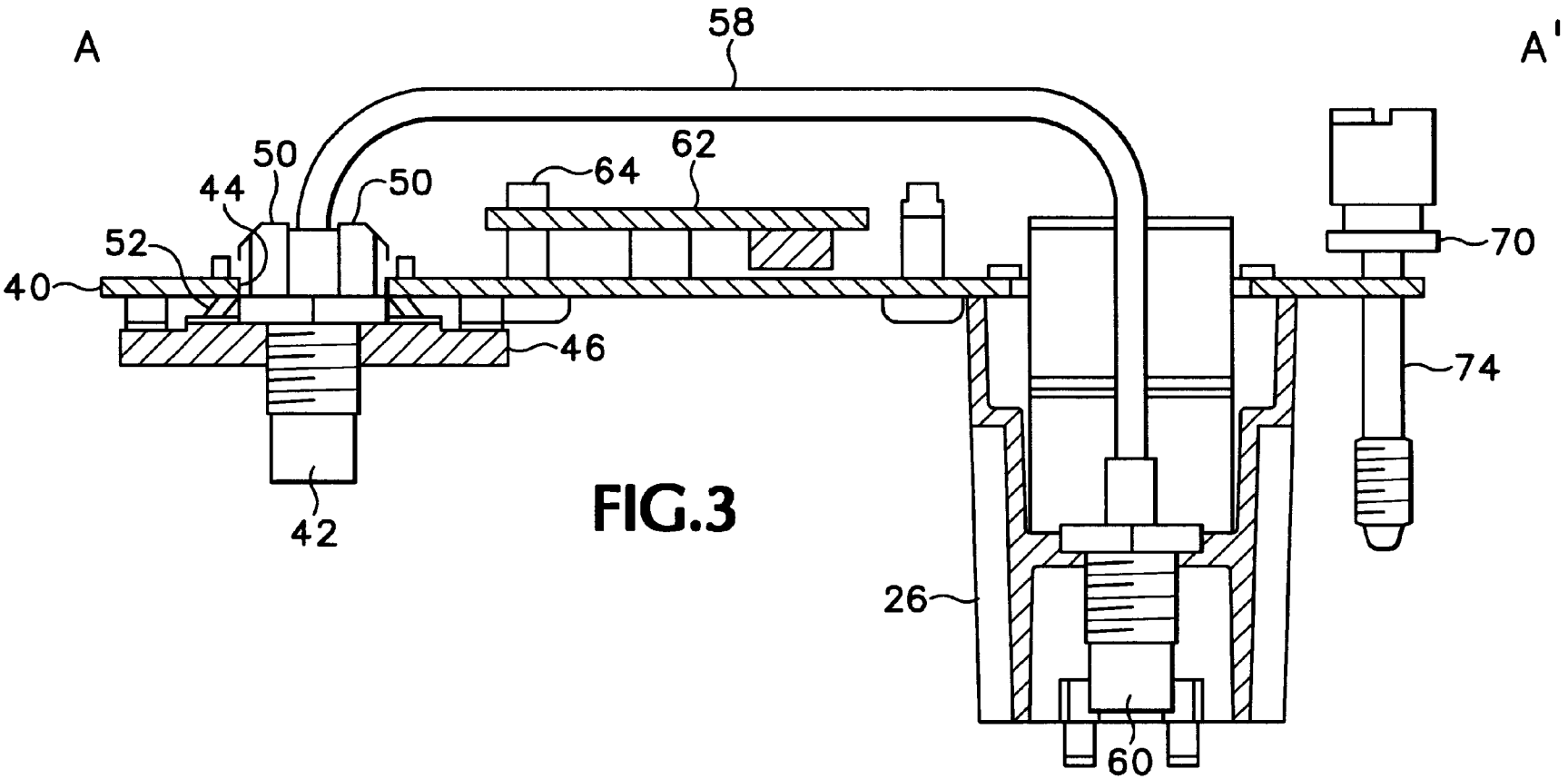
FIG. 3 is a cross-sectional view along line A–A' of the electrical signal interconnect assembly according to the present invention.

Referring to FIG. 2, there is shown an exploded perspective view of the electrical signal interconnect assembly 32. The interconnect assembly has a panel 40 to which a high speed coaxial interconnect 42 is floatably attached over a first aperture 44 formed in the panel 40. As shown in the cross-sectional view of FIG. 3, the coaxial interconnect 42 is attached to a bushing 46 that has an aperture 48 formed therein that receives the interconnect 42. The bushing 46 has opposing flanges 50 on either side of the bushing aperture 48 that are loosely received in the first aperture 44 formed in the panel. Disposed between the bushing 46 and the panel 40 is a finger spring-washer 52. The spring-washer 52 allows fractional movement of the bushing 46 and hence the coaxial interconnect 42. A retaining member 54, such as a retaining ring, is mounted in a groove formed in the flanges 50 to secure the bushing 46 to the panel 40. The spring-washer 52 and the loose fit of the bushing 46 in the aperture 44 enables the bushing 46 and, in turn, the connector 42 to be free floating in three dimensions.

One of the pocket and body of the mechanical alignment facility is also attached to the panel 40 over a second aperture 56 formed in the panel. In the preferred embodiment of the invention, the body 26 is attached to the panel 40. A precision semi-rigid coaxial cable 58 having a central signal conductor and a surrounding shield conductor couples the floating high speed coaxial interconnect 42 to the high speed coaxial interconnect 60 attached to the body 26. The cable 58 is designed with a loop such that it can tolerate the fractional movement of the floating coaxial interconnect 42. A substrate 62, such as a circuit board, having electrical circuitry mounted thereon, is preferably mounted on the panel 40 using well know attachment methods, such as screws 64. A flexible ribbon cable 66 or the like electrically couples the substrate 62 to electrical contacts on the body 26 for data transmission. A housing 68 preferably make of an electrical insulating material, such a plastic or the like, is attached to the panel 40 to cover the components on the panel opposite the floating coaxial interconnect 42 and the body 26. Flanges 70 extend from either side of the housing 68 that mate with the ends of the panel. The flanges 70 and the ends of the panel have mutually aligned apertures 72 formed therein that receive mounting members 74, such as threaded screws, for securing the interconnect assembly 32 to the front panel 24 of the instrument 10 more securely than the latching mechanism of the mechanical alignment facility, which will be described in greater detail below.

The high speed coaxial interconnects are preferably standard BMA or blind mate connector, such as manufactured and sold by M/A-Com Division of Amp, Inc., Lowell, Mass. BMA connectors are constructed such that the male and female sides of the connectors need not be exactly aligned in the axial direction during connection. Further, the design of the BMA connector allows a degree of misalignment between the male and female sides of the interconnect while still providing a reliable high speed interconnect for electrical signal. In the preferred embodiment of the invention, the male sides of the BMA connectors are mounted on the interconnect assembly 32 and the female sides of the BMA connectors are mounted on the instrument 10. Alternatively, the female sides of the BMA connectors may be mounted on the interconnect assembly with the male sides mounted on the instrument or one of the BMA connectors on the interconnect assembly could be a female connector and the other could be the male connector. The structure and operation of the BMA connectors will be described in greater detail below with reference to the mechanical alignment facility.

Figure 4:
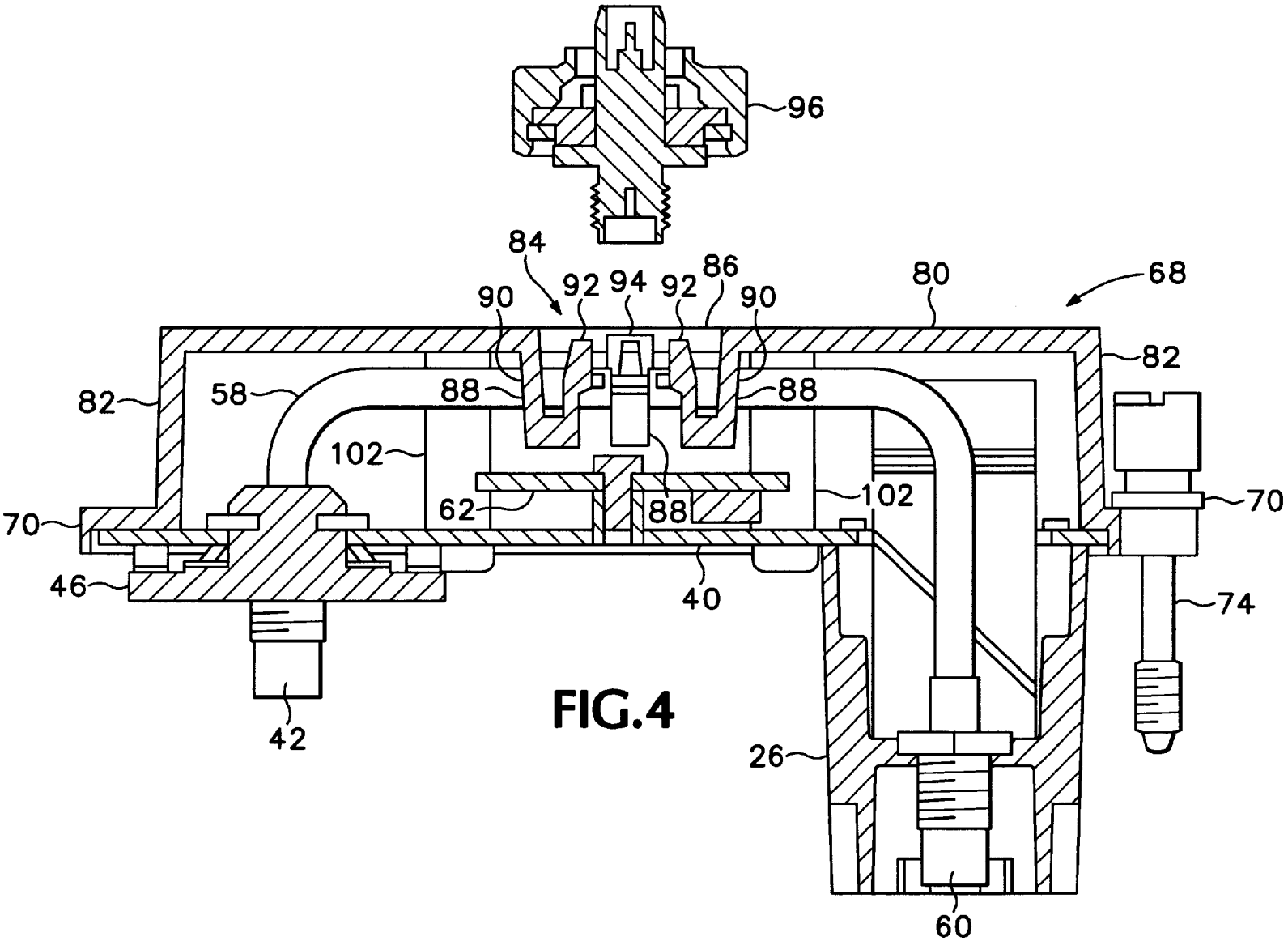
FIGS. 4 and 5 are side-sectional views of alternative embodiments of the housing in the electrical signal interconnect assembly according to the present invention.
Figure 5:
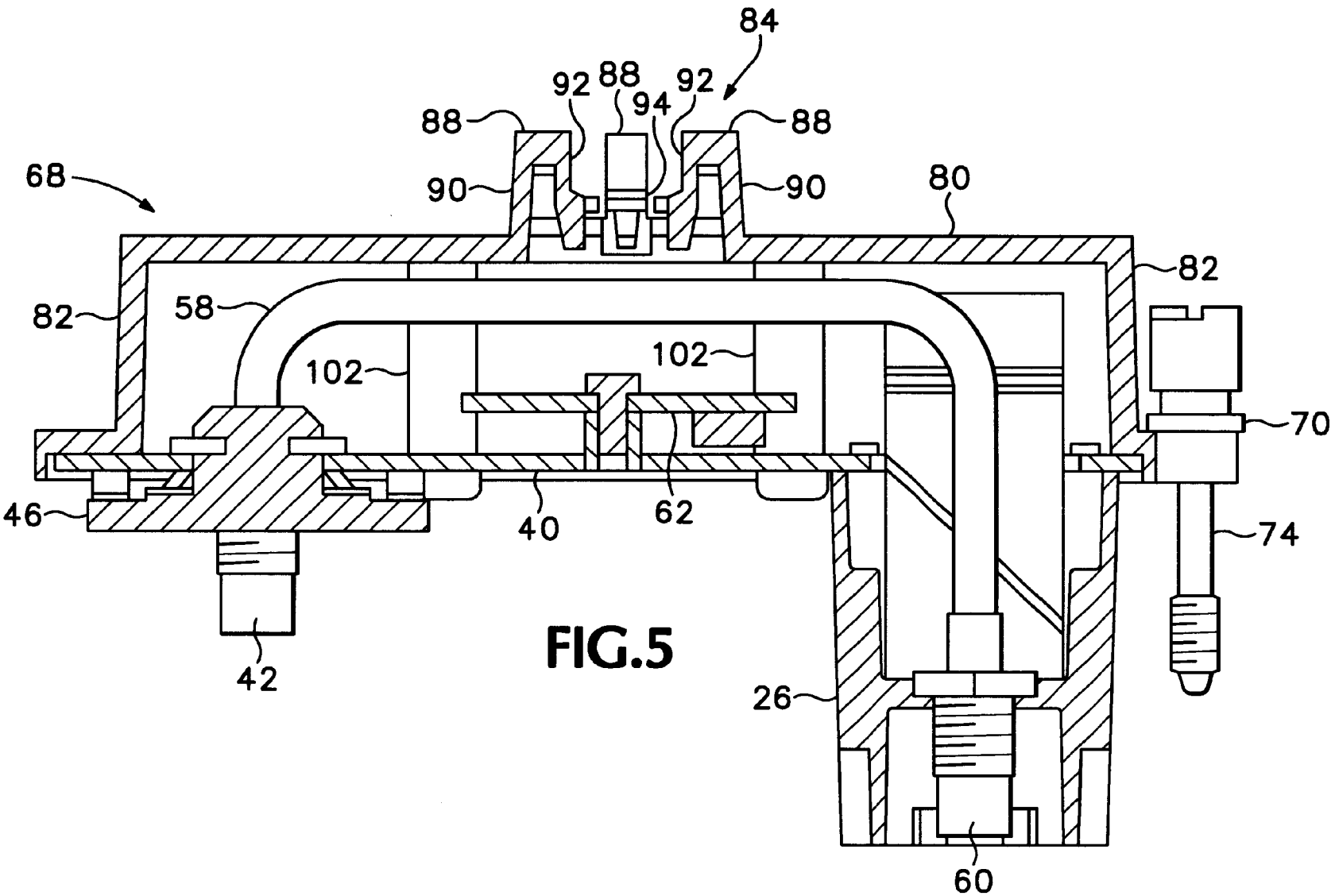
Figure 6:
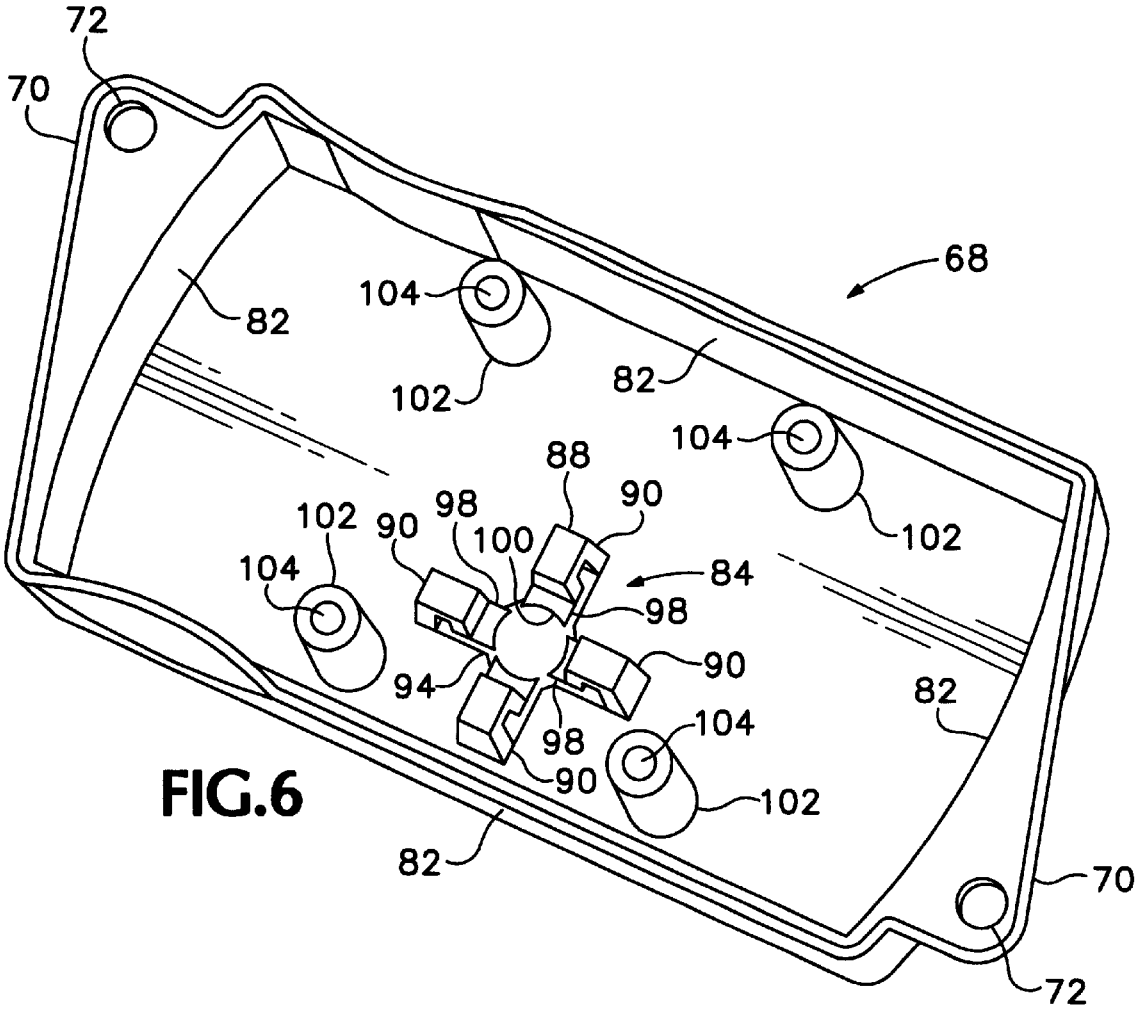
FIG. 6 is a perspective view of the interior side of the housing in the electrical signal interconnect assembly according to the present invention.

Referring to the side-sectional view of FIGS. 4 and 5, the housing 68 has a base 80 and depending sidewalls 82 that are positioned against the panel 40 opposite the BMA connectors 42, 60. The views of FIGS. 4 and 5 also show two alternative embodiments of the housing 68. The embodiments include an accessory holder 84 formed in the base 80 of the housing 68. In the embodiment of FIG. 4, an opening 86 is formed in the base 80 with cantilever spring members 88 disposed on the base around the opening 86 in the direction of the sidewalls 82. Each cantilever spring member 88 has a fixed end 90 attached to the base 80 and a flexible free end 92. The free ends 92 of the spring members 88 define an aperture 94 that receives and holds an adapter 96, such as a BMA interconnect adapter. A BMA interconnect adapter mountable in the accessory holder 84 is described in U.S. patent application, Ser. No. 09/866,347, filed May 24, 2001, titled "A BMA Interconnect Adapter". In the preferred embodiment of the invention, the spring members 88 are integrally formed as part of the housing 68 as shown in the perspective view of the interior of the housing 68 of FIG. 6. As is shown in perspective view, each of the cantilever spring members 88 have an approximately "U" shaped portion with one arm 90 of the "U" fixedly attached to the housing 68. Extending in a normal direction away from the free end arm 92 of the "U" is shoulder 98. The end of the shoulder 98 has a conic section 100 which in conjunction with the other spring members 88 forms the circular aperture 94 for receiving the adapter 96. FIG. 6 also show integrally formed protrusions 102 with bores 104 formed therein extending into the housing 68. The bores 104 in the protrusions mate with corresponding apertures 106 formed in the panel 40 that receive screws for securing the housing 68 to the panel 40. The view of FIG. 5 shows the accessory holder 84 extending above the housing 68 in a direction opposite the sidewalls 82. In all other respects, the structure of the accessory holder 84 is the same as for the holder extending into the housing.

Figure 7:
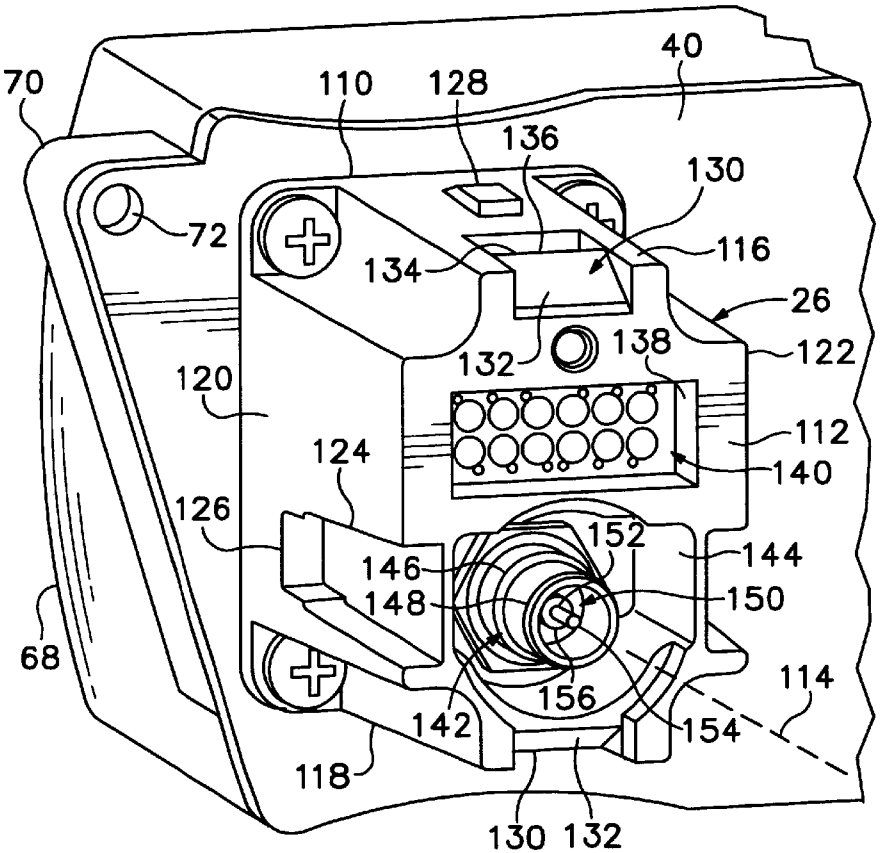
FIG. 7 is perspective view of the mechanical alignment facility body in the electrical signal interconnect assembly according to the present invention.

FIGS. 7, 8, 9 and 10 illustrate the elements implementing the mechanical alignment facility in the electrical signal interconnect assembly 32 of the present invention. As shown in FIG. 7, the mechanical alignment facility interconnect body 26 is a moderately elongated rigid member preferably formed of a rugged material such as nickelplated zinc, die cast aluminum or the like. The body 26 has a trailing face 110 connected to the panel 40 of the interconnect assembly 32, and a parallel leading face or nose 112 facing the opposite direction, normal to a connector axis 114. The remaining upper wall 116, lower wall 118, and sidewalls 120, 122 give the body a roughly rectangular cross section that minimally varies over the length of the body between the leading and trailing faces, except for features as noted below. To facilitate manufacturing by a casting process, and to provide a tightly mating mechanical connection, the body is tapered to be slightly smaller at the nose 112.

The body 26 includes an alignment notch 124 on each sidewall 120, 122. Each notch has an elongated trapezoidal profile extending from the lead face 112 and extends parallel to the axis 114. The distal end of each notch 124 includes a shouldered guide 126 that is manufactured to close size tolerances so that it closely fits the ends of corresponding keys as will be discussed below. The notches 124 are offset from the horizontal center line of the body 26 to prevent the insertion of the body 26 rotated 180 degrees out of position in the interconnect receptacles 22. The body 26 further includes alignment keys 128 on the upper and lower walls 116, 118 that is manufactured to close size tolerances so that it closely fits the ends of corresponding notches as will be discussed below. The shouldered guides 126 and the alignment keys 128 are registered with respect to the nose face 112 such that the guides and keys mate with the corresponding keys and notches at the same time.

The upper and lower surfaces 116, 118 include opposed and symmetrically positioned latch ramps 130. Each ramp has a sloped leading ramp surface 132 and a sloped trailing ramp surface 134 that rise to meet at a ridge or apex 136, which is slightly rounded. The ramps are recessed into the surfaces, so that the apex does not protrude above the surface. Each apex defines a line parallel to the surface 116, 118 in which the ramp is defined, and parallel to the nose surface 112 of the body. The ramp and apex surfaces are preferably formed with a smooth or polished surface finish to reduce wear during latching operations discussed below.

The face 112 of the body defines openings for two different electrical connectors. A first opening 138 provides access to a printed circuit board 140 mounted inside a chamber defined by the body and having a contact face accessible through the opening 138. The board 140 has an array of exposed conductive lands that are connected via the ribbon cable 66 to the circuitry on the substrate 62 in the interconnect assembly 32. The circuitry may have an EPROM or other non-volatile device to provide identification of the interconnect assembly.

In the preferred embodiment the male side 142 of the BMA connector 60 is mounted in a recess 144 defined in the body, and extends parallel to the axis 114. The BMA male side includes a shield sleeve portion 146 having a tapered exterior portion 148 at the free end, which extends to a level slightly recessed below the face 112 to prevent damage to the connector. A central signal conductor 150 has a base portion 152, and an extending free end portion 154 coaxial with the shield sleeve portion. The free end portion 154 has a narrower diameter than the base portion, providing a shoulder 156 facing the leading direction. The free end of the conductor 150 is recessed below the shield portion 146, to prevent damage and to ensure that the shield is connected when the signal conductor makes and breaks contact as will be discussed below.

Figure 8:
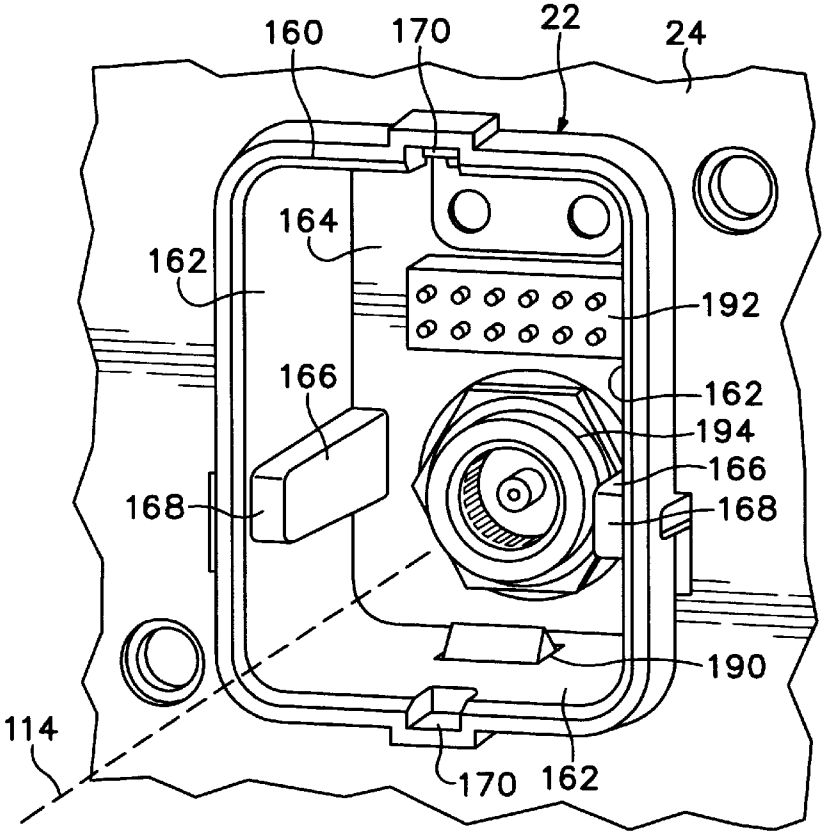
FIG. 8 is perspective view of the mechanical alignment facility pocket in the electrical signal interconnect assembly according to the present invention.

FIG. 8 shows the instrument mounted receptacle 22 which may be a rigid plastic body, die cast aluminum or the like that forms the female side of the connector, and which receives the body 26. The receptacle 22 has a rim 160 that protrudes from the panel 24, and has sidewalls 162 extending to the floor 164 recessed well below the rim and the panel. Each sidewall 162 has an elongated key 166 extending from the rim toward the floor 164, the ends 168 of each key 166 precisely sized to closely receive a corresponding shouldered guide 126 in notch 124 on the body 26. The length of the notches 124 in body 26 are oversized so that the keys 166 do not bottom out in the notches 124 before the BMA connector is fully connected, as will be discussed below. In addition, the depth to which each notch 124 is recessed below the plane of the sidewall 120, 122 in which it is formed is slightly excessive, to provide adequate clearance. The receptacle 22 further includes notches 170 formed in the top and bottom of the rim 160 that mate with the keys 128 on the body 26. The widths of the shouldered guides 126, key ends 168, keys 128 and notches 170 are closely controlled so that precise positioning of the body relative to the receptacle rim is provided in both the vertical and horizontal directions even if the overall dimensions of the body and receptacle are not as narrowly constrained.

Figure 9:
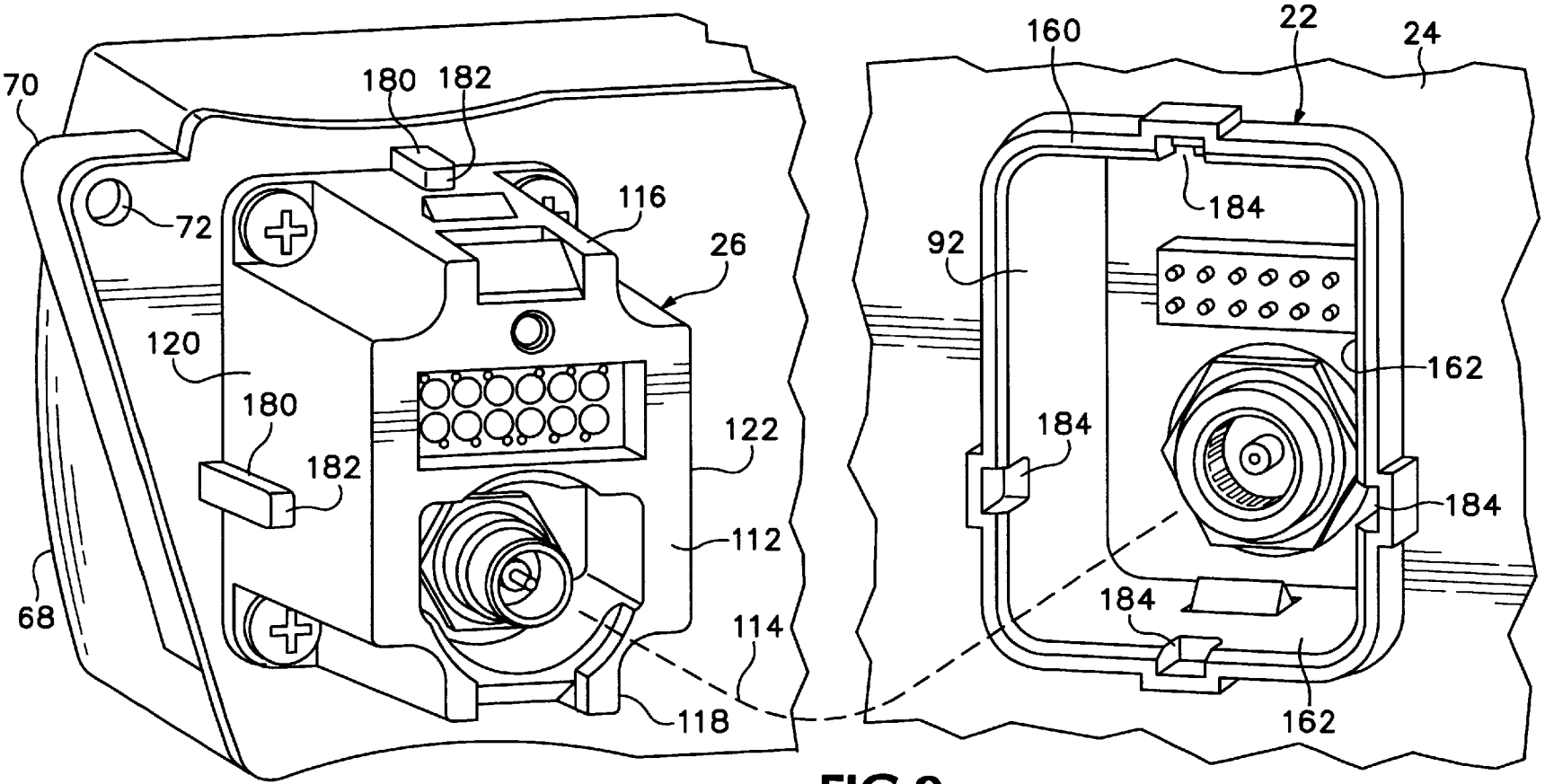
FIG. 9 is a perspective view of the mechanical alignment facility with an alternate notch and rib configuration.
Figure 10:
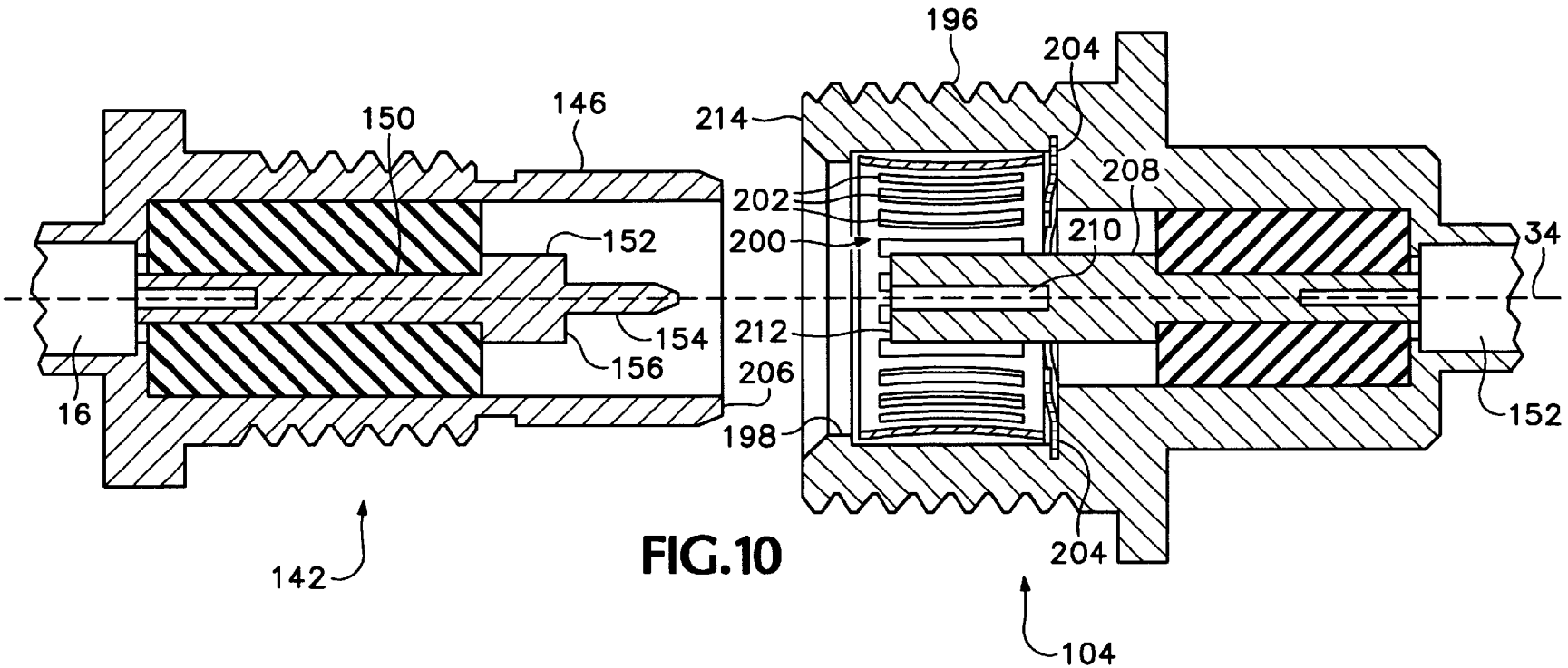
FIG. 10 is an enlarged sectional view taken along the axis of the high speed coaxial interconnect.

The keys and notches in the receptacle and body may be reversed as shown in FIG. 9. The body 26 includes an alignment key 180 on each major face 116, 118, 120, 122 of the body. Each key has an elongated rectangular profile, and extends parallel to the axis 114. The keys are manufactured to close size tolerances so that they closely fit corresponding notches as will be discussed below. The keys are registered with each other so that the leading ends 182 of all keys are equally spaced apart from the nose face 112. Each sidewall 162 of the receptacle 22 defines an elongated notch 184 at the rim 160, each notch precisely sized to closely receive a corresponding key 180 on the connector body 26. The length of each notch 184, that is, the depth to which is extends into the receptacle chamber, is oversized so that the keys 180 do not bottom out in the notches 184 before the BMA connector is fully connected, as will be discussed below. In addition, the depth to which each notch 184 is recessed below the plane of the wall in which it is formed is slightly excessive, to provide adequate clearance. Like the previously described embodiment, the widths of the notches and keys are closely controlled, so that precise positioning of the body relative to the receptacle rim is provided even if the overall dimensions of the body and receptacle are not as narrowly constrained. In other embodiments, each side may have both notches and keys, with the other having an opposite set of corresponding elements.

Thus, the notch and key arrangement permits insertion and extraction along the axis 114, but constrains lateral translation in the two degrees of freedom defined by the front panel plane 24, as well as the rotational degree of freedom about the axis. The remaining translational degree of freedom (along the axis) is constrained by the latching mechanism, and the remaining rotational degrees of freedom (lateral and horizontal bending of the probe connector body from normal to the front panel) are constrained by the connected BMA connector, as will be discussed below.

A symmetrically opposed pair of spring loaded latches 190 protrudes into the receptacle chamber through openings defined in the upper and lower walls of the receptacle, in line with a vertical medial plane. Each latch has a roof shape with sloping faces rising to radiused apex ridges, with the slopes selected to match the surfaces of the latch ramps 134 on the body 26. The slopes are established to provide a lesser insertion force and a greater extraction force by using a gentler slope on the ramp surface 132 and corresponding latch surface than on ramp surface 134 and its corresponding latch surface. The radiused apexes and tight mechanical tolerances of the body/receptacle interface ensure that the latches do not reach a stable condition near the apex with one latch on the inserted side of the apex, and the other on the extracted side. Accordingly, the latches ensure that the connector is either fully connected, or adequately extracted to avoid undesirable partial electrical contact, as will be discussed below.

There are two electrical connector components mounted to the floor 164 and within the receptacle 22, each component being the counterpart of a connector on the body 26. An array of spring loaded pogo pins 192 is positioned to register with the lands of the circuit board 140. The pins have a range of motion with suitable biasing force to accommodate the need that the BMA connector is free to establish the insertion depth of the connection. A female side 194 of the BMA connector is mounted to the floor panel 164, and is shown in greater detail in FIG. 10. The connector has a cylindrical sleeve 196 defining a cylindrical chamber 198.

The sidewalls and floor of the chamber are lined with a leaf spring sleeve 200 having side springs 202 bowing slightly into the chamber, and end spring portions 204 bowing into the chamber from the floor. The side springs compliantly grip the male shield portion 146, even if it were somewhat angularly displaced. For the BMA standard, displacements of up to 5 degrees are tolerated without degradation of the connection. However, such displacement may cause damage to the delicate springs as noted above. The end spring portions provide compliant contact with the end surface 206 of the male shield, tolerating a small range of insertion depths, so that the signal connection may establish the precise insertion depth. A central signal conductor 208 is a rigid sleeve having a bore 210 sized to closely receive the free end portion 154 of the male side conductor. Compliant spring portions (not shown) line the bore to prove effective ohmic contact.

The conductor 208 has a free end surface 212 that is recessed at adequate depth below the free end face 214 of the shield sleeve 196 to protect against damage. In addition, the sleeve extends to an adequate distance relative to the signal conductor to ensure that the shield contact is already made when the signal contact connects and is still made when the signal contact disconnects.

Inserting the body 26 into the receptacle 22 positions the keys 166 in the receptacle 22 into the notches 124 in the body 26. Continued insertion of the body 26 into the receptacle causes the male shield portion 146 to enter the female cylindrical chamber 198. The compliant side springs 202 grip the male shield portion 146 to align the free end portion 154 of the male signal conductor 150 to the bore 210 of the female central signal conductor. Continued insertion of the body 26 into the receptacle 22 engages the ends 168 of the keys 166 into the shouldered guides 126 of notches 124. Likewise, the keys 128 on the top and bottom of the body engage the notches 170 in the rim 160. The connector is fully when the shoulder 156 presses against the face 212 of the female signal conductor. With the shoulder 156 pressed against the face 212 of the female signal conductor, the end surface 206 of the male shield depresses the end spring portions 204 of the leaf spring sleeve 200. The spring latches 190 provide this biasing force.

The present invention has been described with the body of the mechanical alignment facility attached to the interconnect assembly and the pocket mounted on the instrument. It is equally possible to mount the pocket on the interconnect assembly and the body on the instrument. In such a configuration, the sidewalls of the housing would be extended to accommodate the pocket in the interconnect assembly.

A electrical signal interconnect assembly has been described having a panel on which are mounted first and second high speed BMA type coaxial interconnects. The first coaxial interconnect is mounted on a spring biased bushing that allows the interconnect to float. The second coaxial interconnect is attached to one of a pocket and body of a mechanical alignment facility. A precision semi-rigid coaxial cable connects the coaxial connectors together. A housing encloses the side of the panel with the coaxial cable. The housing may also include an accessory holder that is preferable integrally formed in the housing.

It will be obvious to those having skill in the art that many changes may be made to the details of the above-described embodiments of this invention without departing from the underlying principles thereof. The scope of the present invention should, therefore, be determined only by the following claims.

What is claimed is:

1. An electrical signal interconnect assembly comprising:

first and second high speed coaxial interconnects with each coaxial interconnect having a central signal conductor and a surrounding shield conductor, each of the coaxial interconnects having a male side including a male shield contact mateable with a female side having a shield sleeve defining a chamber including a contact facility having a compliant portion operable to flexibly grip the male shield contact;

a panel having a first aperture therein over which one of the male and female mating sides of the first coaxial interconnect is selected and floatingly attached to one side of the panel;

a mechanical alignment facility having coarse and fine mechanical alignment portions with the coarse mechanical alignment portion including a closely mating pocket and body wherein the pocket has a rim and a floor recessed below the rim such that the rim provides a first angular displacement limit of the body, and the fine mechanical alignment portion including a notch defined in one of the pocket and body and a key closely mating with the notch defined in the other of the pocket and body such that the notch provides a second angular displacement limit of the body, with one of the male and female mating sides of the second coaxial interconnect selected and attached to one of the pocket and body;

the panel having a second aperture over which the mechanical alignment facility is attached on the same side of the panel as the first coaxial interconnect; and a coaxial cable having a cental signal conductor and a surrounding shield conductor with the cental signal conductor and the surrounding shield conductor at one end of the coaxial cable attached to one of the coaxial interconnects on the opposing side of the panel and the cental signal conductor and the surrounding shield conductor at one other end of the coaxial cable attached to other coaxial interconnect on the opposing side of the panel.

2. The electrical signal interconnect assembly as recited in claim 1 further comprising a bushing supported over the first panel aperture by a flexible spring member with the bushing having an aperture formed therein for receiving the selected male and female side of the first coaxial interconnect and having opposing flanges formed adjacent to the bushing aperture that extend through the first panel aperture and receive a securing member to mount the bushing to the panel.

3. The electrical signal interconnect assembly as recited in claim 1 further comprising a housing attached to the opposing side of the panel.

4. The electrical signal interconnect assembly as recited in claim 3 wherein the housing further comprises a base having depending sidewalls positioned against the opposing side of the panel and cantilever spring members disposed on the base with each cantilever spring member having a fixed end attached to the base a flexible free end with the free ends defining an aperture.

5. The electrical signal interconnect assembly as recited in claim 4 wherein the cantilever spring members receive and hold an adapter within the aperture formed at flexible free ends.

6. The electrical signal interconnect assembly as recited in claim 4 wherein the cantilever spring members extend above the base in a direction opposite the sidewalls.

7. The electrical signal interconnect assembly as recited in claim 4 wherein the base includes an aperture formed therein with the cantilever spring members disposed adjacent to the aperture and extending below the base in the same direction as the sidewalls.

8. The electrical signal interconnect assembly as recited in claim 4 wherein the cantilever spring members are integrally formed with the housing.

9. The electrical signal interconnect assembly as recited in claim 1 wherein the first and second interconnects are blind mating interconnects.

10. The electrical signal interconnect assembly as recited in claim 1 including an electrical instrument to which associated mating sides of the coaxial interconnects and one of the pocket and body are mounted.

11. The electrical signal interconnect assembly as recited in claim 10 wherein the female mating sides of the interconnects are connected to the instrument.

12. The electrical signal interconnect assembly as recited in claim 1 including a separate electronic data interconnect having a first side connected to the pocket and a second side connected to the body.

13. The electrical signal interconnect assembly as recited in claim 12 wherein at least one side of the data interconnect includes compliant contacts operable to contact a corresponding set of contacts on the other side, over a range of depths with which the body is inserted into the pocket.

14. The electrical signal interconnect assembly as recited in claim 13 where one side of the data interconnect includes pogo pins, and wherein the other side includes a fixed contact surface.

15. The electrical signal interconnect assembly as recited in claim 13 wherein the compliant contact are contained within the pocket.

16. An apparatus comprising:

first and second high speed coaxial interconnects with each coaxial interconnect having a central signal conductor and a surrounding shield conductor, each of the coaxial interconnects having a male side including a male shield contact mateable with a female side having a shield sleeve defining a chamber including a contact facility having a compliant portion operable to flexibly grip the male shield contact;

a measurement instrument having an instrument panel with a first aperture therein in which one of the male and female sides of the first coaxial interconnect is selected and attached to the instrument panel;

a mechanical alignment facility having coarse and fine mechanical alignment portions with the coarse mechanical alignment portion including a closely mating pocket and body wherein the pocket has a rim and a floor recessed below the rim and wherein one side of the second coaxial interconnect is connected to the floor such that the rim provides a first angular displacement limit of the body, and the fine mechanical alignment portion including a notch defined in one of the pocket and body and a key closely mating with the notch defined in the other of the pocket and body such that the notch provides a second angular displacement limit of the body, with one of the pocket and body selected and attached to the instrument panel and one of the male and female sides of the second coaxial interconnect selected and attached to the selected pocket and body;

a signal routing adapter having a panel with a first aperture therein over which the other of the male and female side of the first coaxial interconnect is selected and floatingly attached to one side of the panel;

the panel having a second aperture over which the other of the pocket and body of the mechanical alignment facility is attached on the same side of the panel as the first coaxial interconnect; and a coaxial cable having a cental signal conductor and a surrounding shield conductor with the cental signal conductor and the surrounding shield conductor at one end of the coaxial cable attached to one of the coaxial interconnects on the opposing side of the panel and the cental signal conductor and the surrounding shield conductor at one other end of the coaxial cable attached to other coaxial interconnect on the opposing side of the panel;

whereby the coarse and fine mechanical alignment portions of the mechanical alignment facility and the male and female sides of the first and second coaxial interconnects of the signal routing adapter and the instrument panel mate together.

17. The apparatus as recited in claim 16 wherein the signal routing adapter further comprising a bushing supported over the first panel aperture by a flexible spring member with the bushing having an aperture formed therein for receiving the selected male and female side of the first coaxial interconnect and having opposing flanges formed adjacent to the bushing aperture that extend through thee first panel aperture and receive a securing member to mount the bushing to the panel.

18. The apparatus as recited in claim 16 wherein the signal routing adapter further comprising a housing attached to the opposing side of the panel.

19. The apparatus as recited in claim 18 wherein the housing further comprises a base having depending sidewalls positioned against the opposing side of the panel and cantilever spring members disposed on the base with each cantilever spring member having a fixed end attached to the base a flexible free end with the free ends defining an aperture.

20. The apparatus as recited in claim 19 wherein the cantilever spring members receive and hold an adapter within the aperture formed at flexible free ends.

21. The apparatus as recited in claim 19 wherein the cantilever spring members extend above the base in a direction opposite the sidewalls.

22. The apparatus as recited in claim 19 wherein the base includes an aperture formed therein with the cantilever spring members disposed adjacent to the aperture and extending below the base in the same direction as the sidewalls.

23. The apparatus as recited in claim 19 wherein the cantilever spring members are integrally formed with the housing.

24. The apparatus as recited in claim 16 wherein the first and second interconnects are blind mating interconnects.

25. The apparatus as recited in claim 15 including a separate electronic data interconnect having a first side connected to the pocket and a second side connected to the body.

26. The apparatus as recited in claim 25 wherein at least one side of the data interconnect includes compliant contacts operable to contact a corresponding set of contacts on the other side, over a range of depths with which the body is inserted into the pocket.

27. The apparatus as recited in claim 26 where one side of the data interconnect includes pogo pins, and wherein the other side includes a fixed contact surface.

28. The apparatus as recited in claim 26 wherein the compliant contact are contained within the pocket.

* * * * *